US008138983B2

(12) United States Patent
Oki et al.

(10) Patent No.: US 8,138,983 B2
(45) Date of Patent: Mar. 20, 2012

(54) VEHICLE ANTENNA UNIT

(75) Inventors: Hidehito Oki, Dublin, OH (US); Michael Andrew Pilgrim, Dublin, OH (US); Jason Dutter, Marysville, OH (US); Masashi Noda, Tomioka (JP); Sadao Ohno, Dublin, OH (US)

(73) Assignees: Honda Motor Co., Ltd., Tokyo (JP); Yokowo Co., Ltd., Tokyo (JP)

( * ) Notice: Subject to any disclaimer, the term of this patent is extended or adjusted under 35 U.S.C. 154(b) by 388 days.

(21) Appl. No.: 12/550,664

(22) Filed: Aug. 31, 2009

(65) Prior Publication Data

US 2011/0050518 A1 Mar. 3, 2011

(51) Int. Cl.
*H01Q 1/32* (2006.01)

(52) U.S. Cl. ..... 343/713; 343/711; 343/715

(58) Field of Classification Search ..... 343/713, 343/711, 715

See application file for complete search history.

(56) References Cited

U.S. PATENT DOCUMENTS

| | | | | |
|---|---|---|---|---|
| 4,788,550 | A * | 11/1988 | Chadima, Jr. | 343/712 |
| 6,236,377 | B1 * | 5/2001 | Hussaini et al. | 343/882 |
| 6,496,152 | B2 * | 12/2002 | Nilsson | 343/713 |
| 6,768,467 | B2 | 7/2004 | Jordan | |
| 6,999,032 | B2 * | 2/2006 | Pakray et al. | 343/713 |
| 7,218,284 | B2 | 5/2007 | Aizawa et al. | |
| 7,336,231 | B2 | 2/2008 | Hayashi et al. | |
| 2004/0150572 | A1 | 8/2004 | Ohno et al. | |
| 2007/0046551 | A1 | 3/2007 | Tateno | |

FOREIGN PATENT DOCUMENTS

| | | |
|---|---|---|
| JP | 2004-166202 | 6/2004 |
| JP | 2004-253533 | 8/2008 |

* cited by examiner

*Primary Examiner* — Hoang V Nguyen
(74) *Attorney, Agent, or Firm* — Rankin Hill & Clark LLP

(57) ABSTRACT

A vehicle includes a vehicle frame, a dielectric panel mounted to the vehicle frame, an antenna unit mounted on the dielectric panel, an electrically conductive bracket connected with the antenna unit, and a resilient ground plate connected with the bracket and the vehicle frame. The dielectric panel can be interposed between the antenna unit and the bracket. The resilient ground plate can facilitate grounding the antenna unit to the vehicle frame. A vehicle antenna unit and an antenna mount for the vehicle antenna unit are also disclosed.

20 Claims, 2 Drawing Sheets

VEHICLE ANTENNA UNIT

BACKGROUND

This disclosure relates to an antenna unit for a vehicle. This disclosure is, more particularly, directed to mounting an antenna unit to a vehicle.

Known on-vehicle antenna units are installed on a metal pillar or on a metal roof of a vehicle by making a hole in the metal structure and then holding the antenna unit in place by using a nut screwed down in the interior of the vehicle. When the antenna unit is installed on the metal pillar or metal roof, the metal pillar or roof is in electrical contact with the vehicle frame, which is also metal, such that a ground is established between the vehicle and the antenna.

Where the antenna unit mounts to a dielectric panel, e.g., a glass or plastic panel, a problem occurs in grounding the antenna unit. It is known to mount an antenna unit to a dielectric panel; however, at present the assemblies used to mount the antenna unit to the vehicle fail to minimize or eliminate loads applied to the dielectric panel. Where the dielectric panel is glass, this can be especially problematic. Also, at present the assemblies used to mount the antenna unit to the vehicle also fail to accommodate for clearance variations between the dielectric panel and the vehicle frame.

BRIEF DESCRIPTION

A vehicle that can overcome the aforementioned shortcomings includes a vehicle frame, a dielectric panel mounted to the vehicle frame, an antenna unit mounted on the dielectric panel, an electrically conductive bracket connected with the antenna unit, and a resilient ground plate connected with the bracket and the vehicle frame. The dielectric panel can be interposed between the antenna unit and the bracket. The resilient ground plate can facilitate grounding the antenna unit to the vehicle frame.

Another example of a vehicle that can overcome the aforementioned shortcomings includes a vehicle frame, a dielectric panel mounted to the vehicle frame, an antenna unit mounted on an outer surface of the dielectric panel, a first electrically conductive member connected with the antenna unit, and a second electrically conductive member connected with the first electrically conductive member and the vehicle frame. The first electrically conductive member can be disposed below a lower surface of the dielectric panel. The first electrically conductive member can be offset from the vehicle frame. The second electrically conductive member connects with the first electrically conductive member and the vehicle frame for grounding the antenna unit.

Another example of a combination that can overcome the aforementioned shortcomings includes a vehicle antenna unit and an antenna mount for the vehicle antenna unit. The mount can include an electrically conductive portion connected with the vehicle antenna unit. The electrically conductive portion can include a first surface configured to face a dielectric panel of an associated vehicle and a second surface, which is offset from and facing in a same general direction as the first surface. The second surface can be configured to contact a vehicle frame of the vehicle to facilitate grounding the antenna unit.

DETAILED DESCRIPTION

Figure 1:
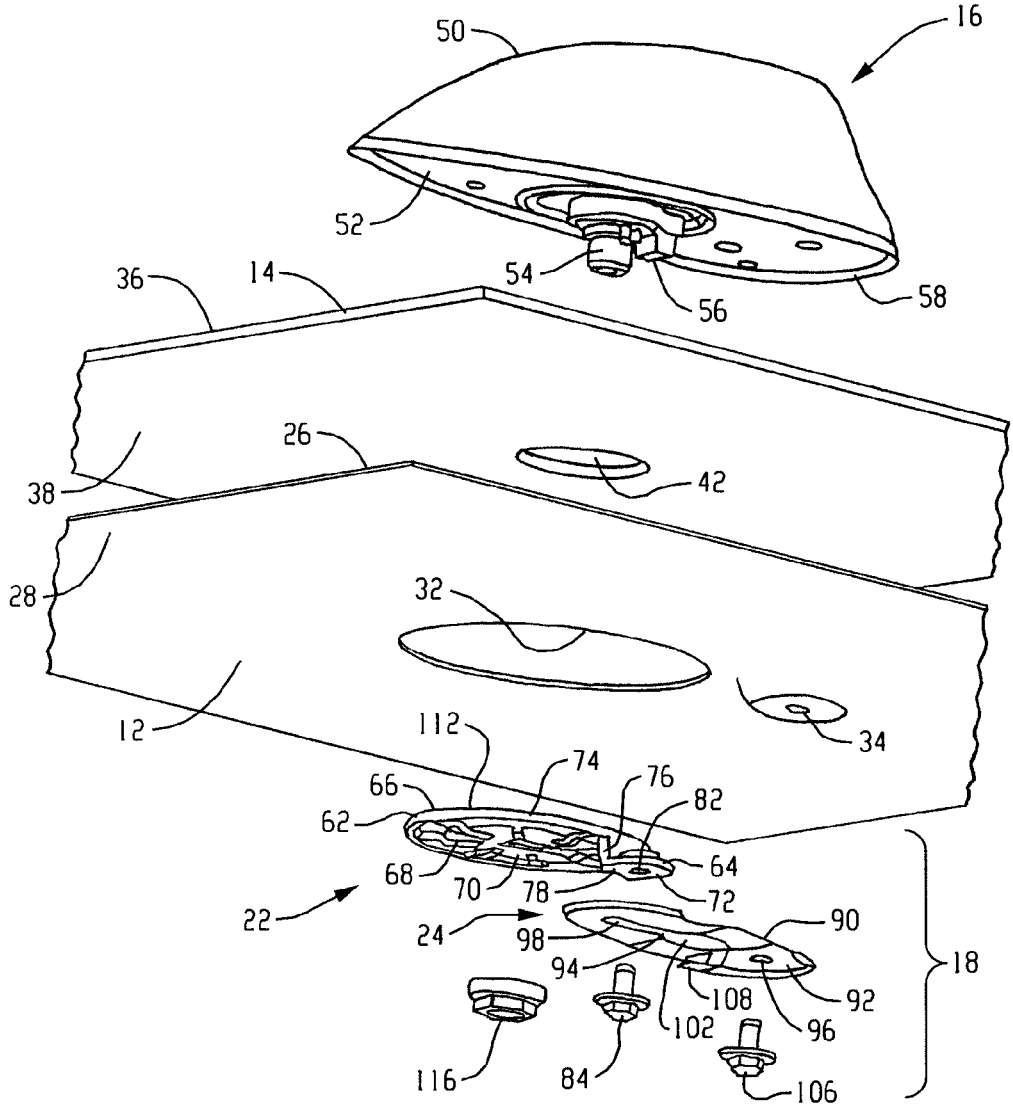
FIG. 1 is a perspective view of a vehicle antenna unit, portions of a vehicle and an exploded view of a vehicle antenna mount.
Figure 2:
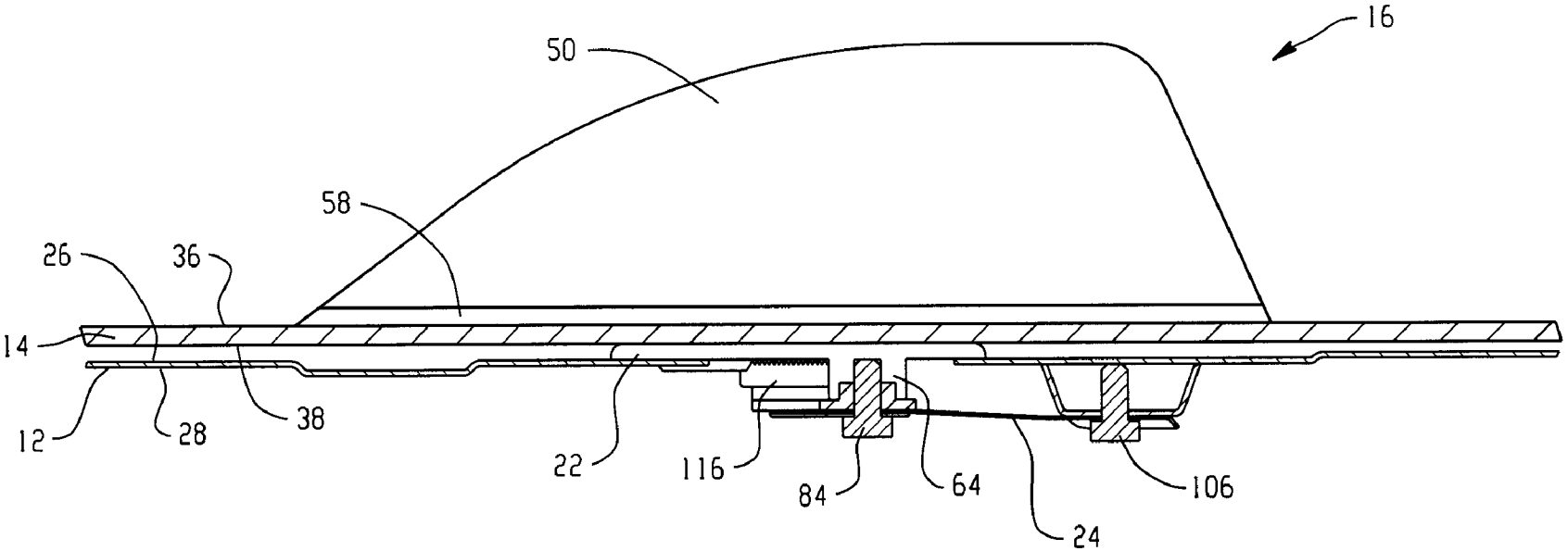
FIG. 2 is a side view, partially in cross section, of the vehicle antenna unit, the antenna mount and the portions of the vehicle shown in FIG. 1.

With reference to FIG. 1, a vehicle (only a portion of the vehicle is shown in FIGS. 1 and 2) includes a vehicle frame 12 (depicted schematically in FIG. 1), a dielectric panel 14 (depicted schematically in FIG. 1) mounted to the vehicle frame 12 and an antenna unit 16 mounted on the dielectric panel. An antenna mount 18 is used for mounting the vehicle antenna unit 16 to the vehicle. The antenna mount 18 includes an electrically conductive portion connected with the antenna unit 16 for grounding the antenna unit to the vehicle frame 12. This provides an electrical path between the antenna 16 and the vehicle frame 12 when the antenna is mounted to the dielectric panel 14. The antenna mount 18 can minimize or eliminate loads applied to the dielectric panel 14 when the antenna unit 16 is connected with the dielectric panel. The antenna mount 18 can also accommodate for clearance variations between the dielectric panel 14 and the vehicle frame 12.

In the embodiment depicted in FIGS. 1 and 2, the electrically conductive portion of the antenna mount includes an electrically conductive bracket 22 and a resilient ground plate 24, which is also electrically conductive. The bracket 22 and the ground plate 24 depicted in FIGS. 1 and 2 are two separate elements that connect to one another. Alternatively, the antenna mount that includes the electrically conductive portion can include one integral electrically conductive element for grounding the antenna unit 16.

With reference back to the embodiment depicted in FIGS. 1 and 2, the vehicle frame 12 is similar to conventional vehicle frames and is made from an electrically conductive material, for example metal. The vehicle frame 12 is depicted schematically in FIGS. 1 and 2. The vehicle frame 12 includes an exterior surface 26 and an interior surface 28. In the embodiment depicted in FIG. 1, the vehicle frame 12 also includes an opening 32 that is covered by the dielectric panel 14 and a fastener opening 34, the purpose of which will be described in more detail below.

With continued reference to the embodiment depicted in FIGS. 1 and 2, the dielectric panel 14 is made from a dielectric material such as glass or plastic. The dielectric panel can include a window, a sun roof, or a plastic exterior panel for the vehicle. The dielectric panel 14 also includes an exterior surface 36 and an interior surface 38. In the embodiment illustrated in FIGS. 1 and 2, the dielectric panel 14 also includes an antenna unit mounting opening 42, which facilitates mounting the antenna unit 16 to the vehicle.

The antenna unit 16 depicted in FIGS. 1 and 2 is similar to known antenna units; though the antenna unit 16 can take other configurations. The antenna unit 16 mounts on the outer surface 36 of the dielectric panel 14. The depicted antenna unit 16 includes a cover 50 connected with a base 52 to enclose a known antenna element (riot visible). A conductive boss 54, which in the depicted embodiment includes external threads, depends downwardly from the base 52. An electrical terminal 56 also depends downwardly from the base. Cables or wires (not shown) connect with terminal 56, or with the antenna element, for taking output from the antenna element to a receiver (not shown) found inside the vehicle. The antenna unit can be used with an AM/FM receiver or a satellite radio receiver, as well as other types of known receivers. A flexible (rubber-like) pad 58 can attach to the base 52 around the periphery thereof and is sealingly interposed between a lower face of the antenna base 52 and the upper surface 36 of the dielectric panel 14 to prevent rain water or the like from invading into the vehicle through the mounting hole 42 found in the dielectric panel.

The antenna mount 18 disclosed in FIGS. 1 and 2 includes the bracket 22, which can also be referred to as a first electrically conductive member, and the resilient ground plate 24, which can be referred to as a second electrically conductive member. The electrically conductive bracket 22 connects with the antenna unit 16. Another way of stating this is that the first electrically conductive member connects with the antenna unit 16. The bracket 22, or the first electrically conductive member, is disposed below the lower surface 38 of the dielectric panel 14. As such, the dielectric panel 14 is interposed between the antenna unit 16 and the bracket 22. The resilient ground plate 24 connects with the bracket 22 and the vehicle frame 12 for grounding the antenna unit 16. In other words, the second electrically conductive member connects with the first electrically conductive member and the vehicle frame 12 for grounding the antenna unit 16.

The bracket 22 is offset from the vehicle frame (laterally offset from the vehicle frame shown in FIGS. 1 and 2) to prevent electrical current from passing from the bracket 22 directly to the vehicle frame 12. In other words, the opening 32 in the vehicle frame 12 is larger than the bracket 22. The illustrated bracket 22 includes a base 62 and a flange 64, which in the depicted embodiment extends downwardly from the base. The base 62 defines an upper surface 66 that faces the dielectric panel 14 and a lower surface 68, which is opposite the upper surface. The base 62 also defines a mounting hole 70, which receives the boss 54 and the terminal 56 of the antenna unit 16. The flange 64 defines an offset surface 72 that is offset (vertically) from the base 62 and the lower surface 68 of the base.

As mentioned above, the bracket 22 is electrically conductive, and can be made from metal. The base 62 of the bracket 22 defines a peripheral edge 74. In the embodiment depicted in FIGS. 1 and 2, the flange 64 is generally L-shaped including a first leg 76 that is integrally formed with and extends generally normal to the base 62 and a second leg 78 that is integral with and generally normal to the first leg. The second leg 78 defines the offset surface 72, which is generally planar in the depicted embodiment. The flange 64 includes a fastener opener 82 that is offset from the peripheral edge 74 of the bracket 22 and the base 62 of the bracket. The fastener opening 82 extends through the second leg 72 of the flange 64. A fastener 84, which in the depicted embodiment is a bolt made from a conductive material, is received in the fastener opening 82 to connect the bracket 22 with the ground plate 24. When received in the fastener opening 82, the fastener 84 is offset (e.g., laterally) from the peripheral edge 74 of the base 62.

With continued reference to the embodiments depicted in FIGS. 1 and 2, the ground plate 24 is also made from an electrically conductive material, e.g., metal. The ground plate 24 is also made from a resilient material, which facilitates clearance variations between the dielectric panel 14 and the vehicle frame 12 during assembly of the vehicle and installation of the antenna unit 16. In the depicted embodiment, the bracket 22, or first electrically conductive member, can be less resilient than the ground plate 24, or the second electrically conductive member.

In the depicted embodiment, the ground plate 24 includes an upper surface 90 and a lower surface 92, which is opposite the upper surface. The upper surface 90 of the ground plate 24 contacts the bracket 22, and more particularly the offset surface 72 of the flange 74, and the vehicle frame 12. This contact allows for electrical current to pass from the antenna unit 16 into the vehicle frame 12. As mentioned above, an alternative embodiment may include only one piece, e.g., the bracket 22 and the ground plate 24 can be made from a single element. In such an antenna mount, the electrically conductive portion can include a first surface, which can be similarly situated to the upper surface 66 of the bracket 22, and a second surface, which can be similarly situated to the upper surface 90 of the ground plate 22. In such a configuration, the first surface is configured to face the dielectric panel 14 and the second surface, which is offset from and facing in a same general direction as the first surface, is configured to contact the vehicle frame 12.

With reference back to the embodiment depicted in FIGS. 1 and 2, the ground plate 24 includes a first fastener opening 94, which in the depicted embodiment is key-shape, and a second fastener opening 96, which is offset from the first fastener opening. Both openings 94 and 96 extend through the ground plate 24. The first fastener opening 94 includes an elongate slot 98 that opens to an enlarged opening 102. The first fastener opening 98 is configured to allow the ground plate 24 to be adjusted (laterally or generally horizontally in the depicted embodiment) with respect to the bracket 22 and the vehicle frame 12 to allow for variations in clearance tolerances between the bracket 22 and the vehicle frame 12. The fastener 84 (the first fastener) is received in the first fastener opening 98 to connect the ground plate 24 to the bracket 22.

The upper surface 90 of the bracket 22 contacts the offset surface 72 of the flange 64 on the bracket 22 such that the upper surface 90 of the ground plate 24 is offset from the lower surface 68 of the base 62 of the bracket 22. This offset configuration, as well as the resiliency of the ground plate 24, facilitates clearance variations between the dielectric panel 14 and the frame 12. Such a configuration is particularly useful.

A second fastener 106 is received in the second fastener opening 96 in the ground plate 24 and the fastener opening 34 in the vehicle frame 12 to connect the ground plate 24 to the vehicle frame. Other manners of connecting the ground plate 24 to the bracket 22 and the vehicle frame 12 can be used, for example the ground plate 24 can be welded to the bracket 22 and the vehicle frame 12. It is desirable that alternative methods for attaching the ground plate 24 to the bracket 22 and the vehicle frame 12 allow for the electrical current to pass from the bracket 22 through the ground plate 24 en route to the vehicle frame 12. The ground plate 24 also includes an integrally formed flange 108 adjacent the enlarged area 102 of the first fastener opening 98.

To mount the antenna unit 16 to the vehicle, the opening 42 is made in the dielectric panel 14. The bracket 22 is attached to the lower surface 38 of the dielectric panel 14 using, in the depicted embodiment, double-sided tape 112. Other adhesives could also be used. The double-sided tape 122 is affixed to the upper surface 66 of the bracket 22 and the lower surface 38 of the dielectric panel 14. Other types of an adhesive member or adhesive element can be interposed between the upper surface 66 of the bracket 22 and the lower surface 38 of the dielectric panel 14. The bracket 22 includes the mounting hole 70 that limits the installation direction of the antenna unit 16 properly positioning the antenna unit with respect to the bracket 22 and the vehicle. The dielectric panel 14 is then installed on the vehicle frame 12 covering the opening 32.

A nut 116 is threaded onto the threaded boss 54 of the antenna unit 16 and tightened down to hold the antenna unit in place. At this time, metal components of the antenna unit 16 connect with the bracket 22 realizing conductivity. Also, since the bracket 22 is installed on the lower surface 38 of the dielectric panel 14, and the flexible pad 58 on the antenna unit 16 is sandwiched between the dielectric panel 14 and the base 52, there is no load (or very little load) applied to the dielectric panel 14. Moreover, water is prevented from intruding into the interior of the vehicle through the opening 42 in the dielectric panel 14.

Next, the ground plate 24 connects to the bracket 22 using the fastener 84. Since the ground plate 24 can be made of spring steel, grounding is realized and the ground plate 24 is able to absorb installation variations between the bracket 22 and the vehicle frame 12. The bracket 24 contacts the vehicle frame 12 and is connected with the vehicle frame using the fastener 106. The fastener 106 is inserted into the opening 96 in the ground plate 24 and the opening 34 in the vehicle frame 12. Accordingly, connectivity is realized between the antenna unit 16 and the vehicle frame 12.

A vehicle including an antenna unit and an antenna mount have been described in detail. Modifications and alterations will occur to others upon reading and understanding the preceding detailed description. It is intended that the invention be construed as including all such modifications and alterations insofar as they come within the scope of the appended claims or the equivalents thereof.

The invention claimed is:

1. A vehicle comprising:
a vehicle frame;
a dielectric panel mounted to the vehicle frame;
an antenna unit mounted on the dielectric panel;
an electrically conductive bracket connected with the antenna unit, the dielectric panel being interposed between the antenna unit and the bracket; and
a resilient ground plate connected with the bracket and the vehicle frame for grounding the antenna unit.

2. The vehicle of claim 1, wherein the bracket is offset from the vehicle frame to prevent electrical current from passing from the bracket directly to the vehicle frame.

3. The vehicle of claim 1, wherein the bracket includes a base and a flange extending from the base and defining an offset surface that is offset from the base, the base defines an upper surface facing the dielectric panel and the flange defines a fastener opening for receiving a fastener for connecting the ground plate to the bracket.

4. The vehicle of claim 3, wherein the ground plate includes an upper surface that contacts the flange and the vehicle frame.

5. The vehicle of claim 4, wherein the upper surface of the ground plate is offset from a lower surface of the base of the bracket.

6. The vehicle of claim 1, wherein the bracket defines an upper surface facing a lower surface of the dielectric panel and a lower surface opposite the upper surface.

7. The vehicle of claim 6, further comprising an adhesive member interposed between the upper surface of the bracket and the lower surface of the dielectric panel.

8. The vehicle of claim 6, wherein the ground plate is offset from the lower surface of the dielectric panel.

9. A vehicle comprising:
a vehicle frame;
a dielectric panel mounted to the vehicle frame;
an antenna unit mounted on an outer surface of the dielectric panel;
a first electrically conductive member connected with the antenna unit and disposed below a lower surface of the dielectric panel, the first electrically conductive member being offset from the vehicle frame; and
a second electrically conductive member connected with the first electrically conductive member and the vehicle frame for grounding the antenna unit.

10. The vehicle of claim 9, further comprising an electrically conductive fastener connecting the first electrically conductive member with the second electrically conductive member.

11. The vehicle of claim 10, wherein the electrically conductive fastener is a first bolt, and further comprising a second bolt for connecting the second electrically conductive member with the vehicle frame.

12. The vehicle of claim 11, wherein the second electrically conductive member includes an elongate slot for receiving at least one of the bolts.

13. The vehicle of claim 9, further comprising an adhesive element interposed between the first electrically conductive member and the dielectric panel.

14. The vehicle of claim 9, wherein the first electrically conductive member includes a base and a flange extending downwardly from the base and defining an offset surface that is offset from the base, the base defines an upper surface facing the dielectric panel and the flange defines a fastener opening for receiving a fastener for connecting the ground plate to the bracket.

15. The vehicle of claim 9, wherein the first electrically conductive member is less resilient than the second electrically conductive member.

16. In combination:
a vehicle antenna unit; and
an antenna mount for the vehicle antenna unit, the mount including an electrically conductive portion connected with the antenna unit, the electrically conductive portion including a first surface configured to face a dielectric panel of an associated vehicle and a second surface, which is offset from and facing in a same general direction as the first surface, configured to contact a vehicle frame of the vehicle.

17. The combination of claim 16, wherein the electrically conductive portion includes a bracket connected with a resilient ground plate.

18. The combination of claim 17, wherein the bracket includes a flange.

19. The combination of claim 18, further comprising a fastener, wherein the flange includes a fastener opening and the fastener opening is offset from a peripheral edge of the bracket, wherein the fastener is received in the fastener opening to connect the bracket with the ground plate and the fastener is offset from the peripheral edge of the base.

20. The combination of claim 17, wherein the bracket includes a base and a flange extending downwardly from the base and defining an offset surface that is offset from the base, wherein the ground plate is offset from a lower surface of the base.

* * * * *